US009750314B2

(12) United States Patent
Ausnit et al.

(10) Patent No.: US 9,750,314 B2
(45) **Date of Patent: *Sep. 5, 2017**

(54) LEAK-RESISTANT SLIDER SELECT ZIPPER

(71) Applicant: ILLINOIS TOOL WORKS INC., Glenview, IL (US)

(72) Inventors: Steven Ausnit, New York, NY (US); Eric Plourde, Frankfort, IL (US); Charles Greco, Bardonia, NY (US); Glyn Russell, New City, NY (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/964,875

(22) Filed: Dec. 10, 2015

(65) Prior Publication Data

US 2016/0088907 A1 Mar. 31, 2016

Related U.S. Application Data

(62) Division of application No. 13/967,773, filed on Aug. 15, 2013, now Pat. No. 9,216,845.

(60) Provisional application No. 61/718,940, filed on Oct. 26, 2012.

(51) Int. Cl.

| | |
|---|---|
| ***B65D 33/16*** | (2006.01) |
| ***A44B 19/32*** | (2006.01) |
| ***B65D 33/25*** | (2006.01) |
| ***A44B 19/16*** | (2006.01) |

(52) U.S. Cl.

CPC ..... *A44B 19/32* (2013.01); *A44B 19/16* (2013.01); *B65D 33/2591* (2013.01); *Y10T 24/2532* (2015.01)

(58) Field of Classification Search

CPC ..... B65D 33/2591; A44B 19/32; A44B 19/16
USPC ..... 383/64, 210, 59
See application file for complete search history.

(56) References Cited

U.S. PATENT DOCUMENTS

| | | | |
|---|---|---|---|
| 3,173,184 | A | 3/1965 | Ausnit |
| 3,220,076 | A | 11/1965 | Ausnit et al. |
| 3,259,951 | A | 7/1966 | Zimmerman |
| 5,020,194 | A | 6/1991 | Herrington et al. |
| 5,067,208 | A | 11/1991 | Herrington et al. |
| 5,301,394 | A | 4/1994 | Richardson et al. |

(Continued)

FOREIGN PATENT DOCUMENTS

| | | |
|---|---|---|
| FR | 61824 | 5/1955 |
| JP | 2007238168 | 9/2007 |

(Continued)

OTHER PUBLICATIONS

International Preliminary Report on Patentability issued in PCT/US2013/063774 dated May 7, 2014.

(Continued)

*Primary Examiner* — Jes F Pascua
(74) *Attorney, Agent, or Firm* — McCarter & English, LLP

(57) ABSTRACT

The present disclosure relates to a leak-resistant slider zipper. The zipper typically includes end seals at the opening and closing ends of the zipper, an upper and a lower set of interlocking elements, first and second upper flanges above the upper interlocking elements having no gaps or cut-outs therein, and first and second lower flanges below the lower interlocking elements, one of the lower flanges being folded back on itself, and a slider.

2 Claims, 6 Drawing Sheets

(56) References Cited

U.S. PATENT DOCUMENTS

| | | | | |
|---|---|---|---|---|
| 5,722,128 | A | 3/1998 | Toney et al. | |
| 6,088,887 | A * | 7/2000 | Bois | B65D 33/2508 24/399 |
| 6,220,754 | B1 | 4/2001 | Stiglic et al. | |
| 6,287,001 | B1 * | 9/2001 | Buchman | B65D 33/2591 24/400 |
| 6,450,686 | B1 | 9/2002 | May | |
| 6,481,890 | B1 | 11/2002 | Vandenheuvel | |
| 6,568,046 | B1 | 5/2003 | Savicki et al. | |
| 6,575,628 | B1 | 6/2003 | Borchardt et al. | |
| 6,595,689 | B1 | 7/2003 | Borchardt | |
| 6,739,755 | B2 * | 5/2004 | Schreiter | B65D 33/2591 24/400 |
| 6,789,947 | B1 | 9/2004 | Kasai | |
| 6,826,808 | B2 * | 12/2004 | Kutschka | B65D 33/2591 24/399 |
| 6,883,210 | B1 | 4/2005 | Savicki | |
| 6,895,641 | B1 | 5/2005 | Savicki | |
| 6,928,702 | B1 | 8/2005 | Savicki | |
| 6,981,299 | B2 | 1/2006 | Savicki, Sr. | |
| 6,996,879 | B1 | 2/2006 | Savicki | |
| 7,052,181 | B2 * | 5/2006 | Smith | B65D 33/2591 24/400 |
| 7,159,282 | B2 | 1/2007 | Blythe et al. | |
| 7,416,338 | B2 * | 8/2008 | Ausnit | B65D 33/2591 24/399 |
| 7,506,487 | B2 * | 3/2009 | Eads | B31B 19/36 383/203 |
| 7,540,662 | B2 | 6/2009 | Thieman | |
| 7,849,565 | B2 | 12/2010 | Swain et al. | |
| 8,332,993 | B2 * | 12/2012 | Roger | B65D 33/2591 24/400 |
| 8,677,570 | B2 * | 3/2014 | Swain | B65D 33/2591 24/30.5 L |
| 9,216,845 | B2 * | 12/2015 | Ausnit | B65D 33/2591 |
| 9,365,326 | B2 * | 6/2016 | Bois | B65D 33/2541 |
| 2004/0045138 | A1 | 3/2004 | Kasai | |
| 2004/0074799 | A1 | 4/2004 | Bell et al. | |
| 2004/0086206 | A1 | 5/2004 | Tomic | |
| 2004/0136618 | A1 | 7/2004 | Ausnit et al. | |
| 2006/0269170 | A1 | 11/2006 | Chaturvedi | |
| 2007/0000098 | A1 | 1/2007 | Ausnit | |
| 2007/0065051 | A1 | 3/2007 | Eads | |
| 2010/0147425 | A1 | 6/2010 | Swain et al. | |
| 2010/0170900 | A1 | 7/2010 | Roger | |
| 2010/0170901 | A1 * | 7/2010 | Roger | B65D 33/2591 220/324 |
| 2010/0310196 | A1 * | 12/2010 | Roger | B65D 33/2591 383/64 |
| 2011/0103717 | A1 | 5/2011 | Kasai | |
| 2013/0148916 | A1 | 6/2013 | Bois | |

FOREIGN PATENT DOCUMENTS

| | | |
|---|---|---|
| WO | 00/76352 | 12/2000 |
| WO | 2007/139646 | 12/2007 |
| WO | 2008/137295 | 11/2008 |

OTHER PUBLICATIONS

International Search Report issued in PCT/US2013/063774 dated Mar. 3, 2014.

* cited by examiner

LEAK-RESISTANT SLIDER SELECT ZIPPER

The present application is a divisional of U.S. Ser. No. 13/967,773, which was filed Aug. 15, 2013 which claims priority under 35 U.S.C. 119(e) of provisional application Ser. No. 61/718,940, which was filed on Oct. 26, 2012, the disclosure of which is hereby incorporated by reference in its entirety.

BACKGROUND OF THE DISCLOSURE

Field of the Disclosure

The present disclosure relates to a leak-resistant slider zipper with upper and lower interlocking elements.

Description of the Prior Art

The prior art includes a large number of zippers intended to be leak-resistant zippers. One prior art group includes zippers having sliders with a separating finger between the tracks to separate one or more tracks of interlocking elements to open the zipper Another prior art group includes separating devices which are positioned above the tracks of the interlocking elements, and typically include gaps or cut-outs within the zipper to accommodate the separating devices when the zipper is in a closed configuration and the operation of the separating devices is not required.

Typical prior art references include U.S. Pat. No. 3,173,184 entitled "Shaped Head Top Closure"; U.S. Pat. No. 3,220,076 entitled "Slide Fastener"; U.S. Pat. No. 3,259,951 entitled "Slide Fastener"; U.S. Pat. No. 5,020,194 entitled "Leakproof Zipper with Slider"; U.S. Pat. No. 5,067,208 entitled "Plastic Reclosable Fastener with Self-Locking Slider"; U.S. Pat. No. 5,301,394 entitled "Plastic Reclosable Fastener with Slider Detent Lock for Locking Slider in Closed Position"; U.S. Pat. No. 6,450,686 entitled "Resealable Package Having a Reinforced Slider Zipper"; U.S. Pat. No. 6,481,890 entitled "Reclosable Zipper Having Intermittent Thickened Flange; Package; and Methods"; U.S. Pat. No. 6,568,046 entitled "Closure Device"; U.S. Pat. No. 6,595,689 entitled "Closure Device"; U.S. Pat. No. 6,575,628 entitled "Closure Device"; U.S. Pat. No. 6,789,947 entitled "Plastic Fastener with Slider and Bag Body Provided with the Plastic Fastener and Method of Producing the Bag Body"; U.S. Pat. No. 6,883,210 entitled "Closure Device"; U.S. Pat. No. 6,895,641 entitled "Closure Device"; U.S. Pat. No. 6,928,702 entitled "Closure Device"; U.S. Pat. No. 6,996,879 entitled "Closure Device"; U.S. Pat. No. 7,159,282 entitled "Reclosable Fasteners or Zippers for Use with Polymeric Bags" and U.S. Pat. No. 7,540,662 "Flexible Package Including a Docking Station Formed from a Plurality of Closely Spaced Slits".

OBJECTS AND SUMMARY OF THE DISCLOSURE

It is therefore an object of the present disclosure to provide leak-resistant zippers for reclosable containers wherein when the zipper is open, the zipper is visibly clearly open to the consumer, and when the zipper is closed, it is leak-resistant.

It is therefore a further object of the present disclosure to provide a leak-resistant zipper which typically reduces or eliminates the need for a gap or cut-out within a part of the zipper to accommodate the separating devices when the zipper is in a closed configuration.

These and other objects are obtained by a zipper, wherein when the zipper is applied to a bag and the slider is adjacent to or in contact with the closing end seal of the zipper or zipper bag, a barrier is created by the inside and outside of the zipper bag.

The zipper typically includes end seals at the opening and closing ends of the zipper, an upper and a lower set of interlocking elements, first and second upper flanges above the upper interlocking elements having no gaps or cut-outs therein and first and second lower flanges below the lower interlocking elements with the second flange folded back against its set of interlocking elements, and a slider.

BRIEF DESCRIPTION OF THE DRAWINGS

Further objects and advantages of the disclosure will become apparent from the following description and from the accompanying drawings, wherein.

DETAILED DESCRIPTION OF THE PREFERRED EMBODIMENTS

Figure 1:
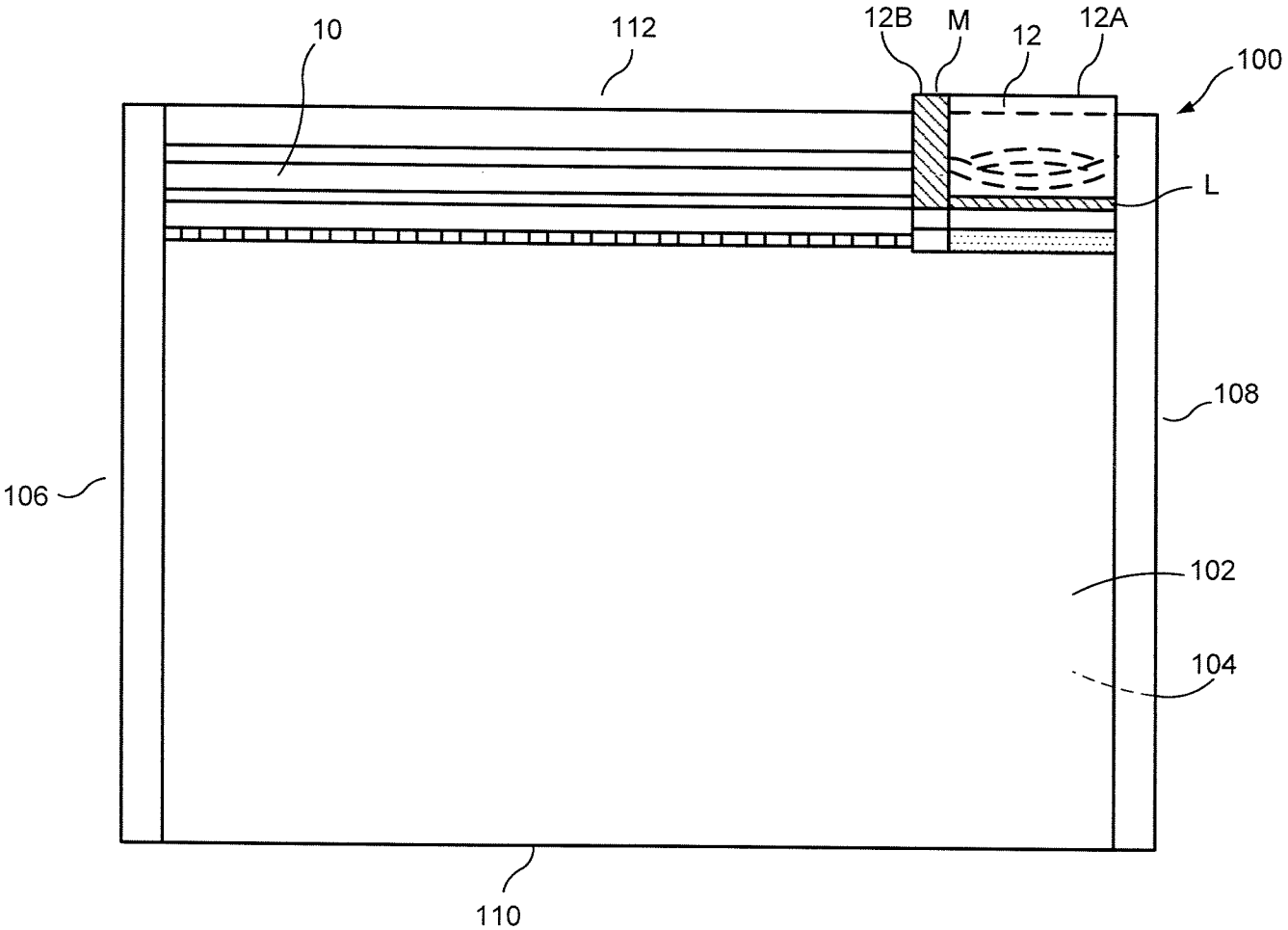
FIG. 1 is a plan view of a typical reclosable package used in the present disclosure.

Referring to the disclosure in detail wherein like numerals indicate like elements throughout the several views, one sees that FIG. 1 is a diagram of a reclosable package 100, typically formed with front and rear polymeric walls 102, 104, opening side seal 106, closing end side seal 108, a bottom fold or seal 110, and a mouth 112 which is made reclosable with a zipper 10, including slider 12 with opening end 12A and closing end 12B.

Figure 2:
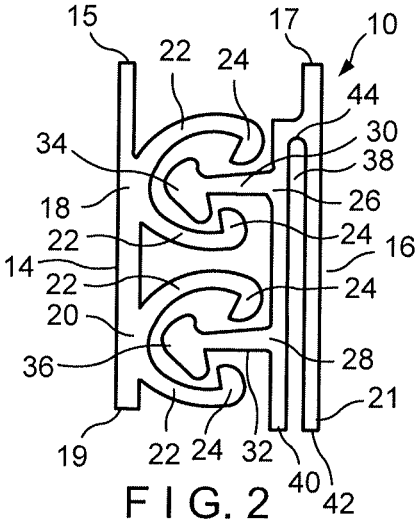
FIG. 2 is a cross-sectional view of a first embodiment of the zipper of the present disclosure.

While a broad range of zippers 10 to be attached to a reclosable package as shown in FIG. 1 may be used in the present disclosure, representative zippers are illustrated in the various figures. FIG. 2 illustrates a double zipper embodiment with first and second zipper profiles 14, 16 upwardly terminating in respective first and second upper flanges 15, 17 and downwardly terminating in first and second lower flanges 19, 21. The first and second upper flanges 15, 17 are typically continuous from one end seal to the other. That is, upper flanges 15, 17 are typically free of gaps or cut-outs. The first zipper profile 14 includes first and second female interlocking elements 18, 20 formed by arcuate extending arms 22 terminating in detent hooks 24 thereby forming volumes for receiving the respective first and second male interlocking elements 26, 28 of second zipper profile 16. First and second male elements 26, 28 include respective first and second shafts 30, 32 terminating in respective first and second arrowhead detent elements 34, 36. In this illustrated embodiment, the arrowhead detent elements 34, 36 are enlarged on the lower sides thereby reducing the required opening force from the consumer side and increasing the required opening force from the product side. Additionally, the second zipper profile 16 includes a hinge structure 38 formed by an inner flange 40, from which the first and second male elements 26, 28 extend, and an outer flange 42, joining at pivot point 44 downwardly adjacent from the top surface of second zipper profile 16.

Figure 3:
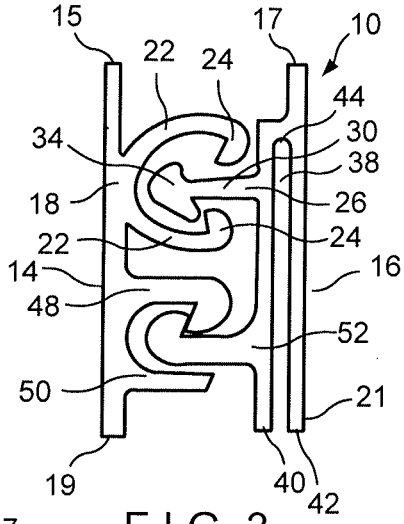
FIG. 3 is a cross-sectional view of a second embodiment of the zipper of the present disclosure.
Figure 4:
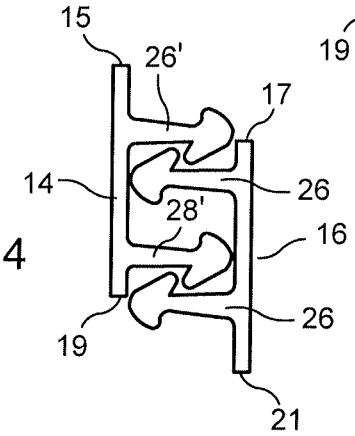
FIG. 4 is a cross-sectional view of a third embodiment of the zipper of the present disclosure.

FIG. 3 is similar to FIG. 2, except that second female interlocking element 20 is replaced with a first arm 48 with a self-mating hook (in that it can mate with a similar or identical structure) and a guide post 50 and second male interlocking structure is replaced with a second arm 52 with a self-mating hook. FIG. 4 illustrates a zipper 10 with a first zipper profile 14 with male elements 26', 28' and a second zipper profile 16 with male elements 26, 28.

Figure 5:
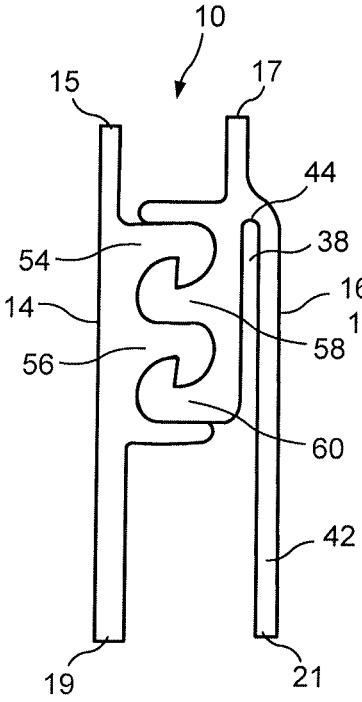
FIG. 5 is a cross-sectional view of a fourth embodiment of the zipper of the present disclosure.
Figure 7:
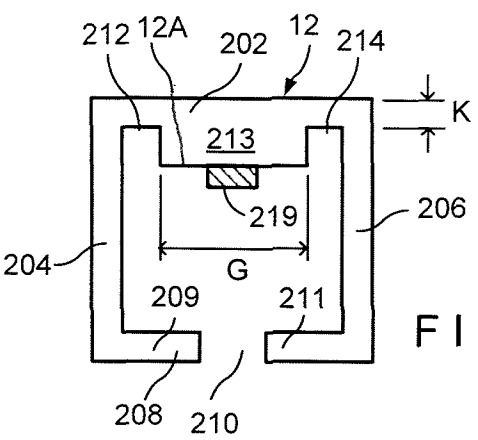
FIG. 7 is a cross-sectional view of a slider of the present disclosure.
Figure 9:
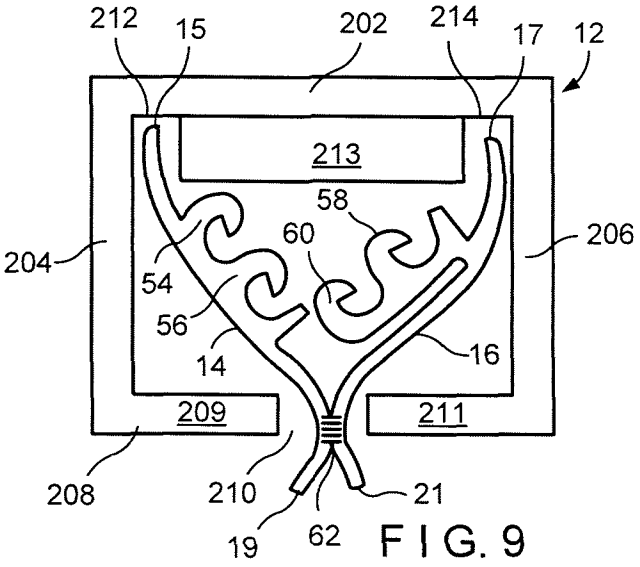
FIG. 9 is a cross-sectional view of a fourth embodiment of the zipper within the slider.
Figure 8:
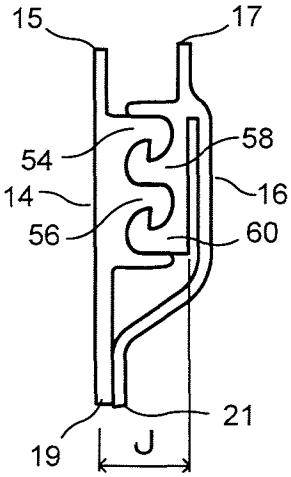
FIG. 8 is a cross-sectional view of the fourth embodiment of the zipper, previously illustrated in FIG. 5, illustrating the configuration of a slider, at the closing end.

FIG. 5 illustrates a zipper 10 with a first zipper profile 14 with two self-mating hooks 54, 56 engaging the two self-mating hooks 58, 60 of the second zipper profile 16. Similar to FIG. 2, this figure illustrates a hinge structure 38 formed by an outer flange 42, joining at pivot point 44 downwardly adjacent from second upper flange 17. FIGS. 6 and 7 illustrate a slider 12, formed from upper wall 202, first and second side walls 204, 206 and first and second inwardly facing slider retaining ribs 209, 211 forming an opening 210 through which the lower flanges (folded and unfolded) of the zipper extend. FIG. 6 further illustrates slider 12 engaging the first and second upper flanges 15, 17 of the zipper 10 of FIG. 6 in respective first and second wedge-diverging channels 212, 214 (thereby forming separating wedge 213 therebetween) formed on the ends of the interior of upper wall 202, to separate the first and second zipper profiles 14, 16. FIG. 8 further illustrates the zipper of FIG. 5 in a closed configuration with the lower portions of first and second zipper profiles 14, 16 urged together, such as may be done by slider 12. FIG. 9 illustrates a zipper 10 similar to that of FIG. 5 except that a lip seal 62 has been added between the first and second lower flanges 19, 21 of the first and second zipper profiles 12, 14. In other words, the first and second lower flanges 19, 21 press together to form a lip seal 62 closely below the interlocking elements 20, 28, and the lip seal 62 extends only the length of the slider 12, when the slider 12 is in contact with the zipper bag closing end seal 108.

Figure 6A:
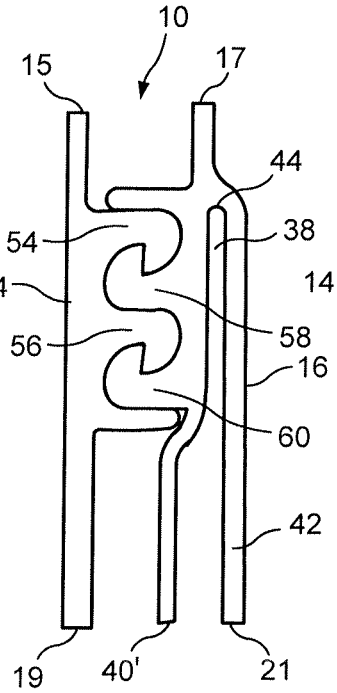
FIG. 6A is a cross-sectional view of a variation of the fourth embodiment of the zipper within a slider.
Figure 6B:
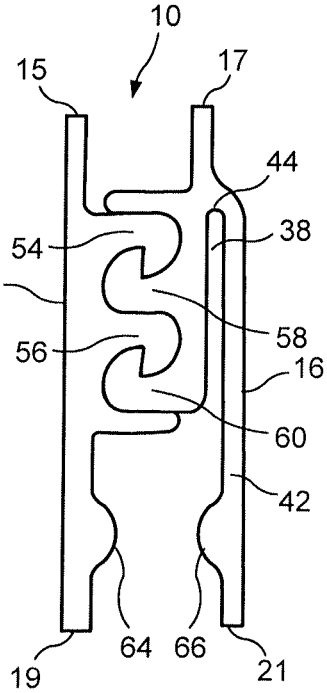
FIG. 6B is a cross-sectional view of a further variation of the fourth embodiment of the zipper of the present disclosure.
Figure 6:
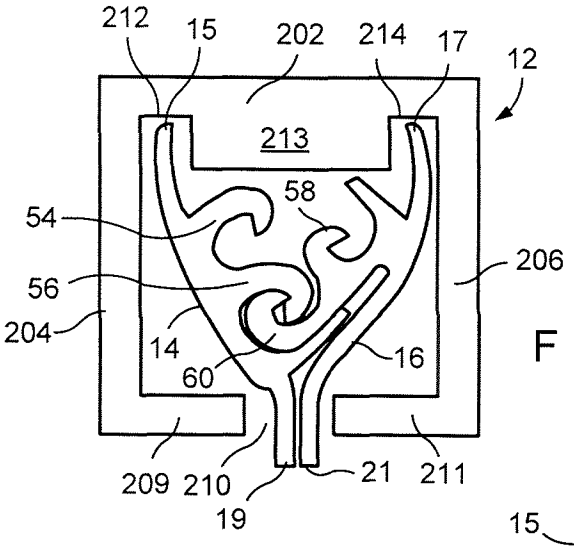
FIG. 6 is a cross-sectional view of the fourth embodiment of the zipper as engaged by a slider.
Figure 10:
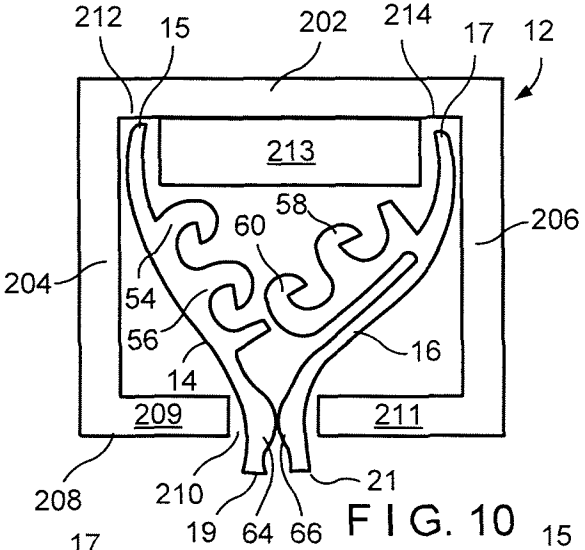
FIG. 10 is a cross-sectional view of a fourth embodiment of the zipper within the slider.

FIGS. 6A and 10 illustrate a similar embodiment as illustrated in FIGS. 5 and 6, except that first and second inwardly extended thickened protrusions 64, 66 have been added to first and second lower flanges 19, 21 of first and second zipper profiles 14, 16 at a position where they pass through opening 210 in lower wall 208 of slider 12 between first and second inwardly facing slider retaining ribs 209, 211.

Figure 11:
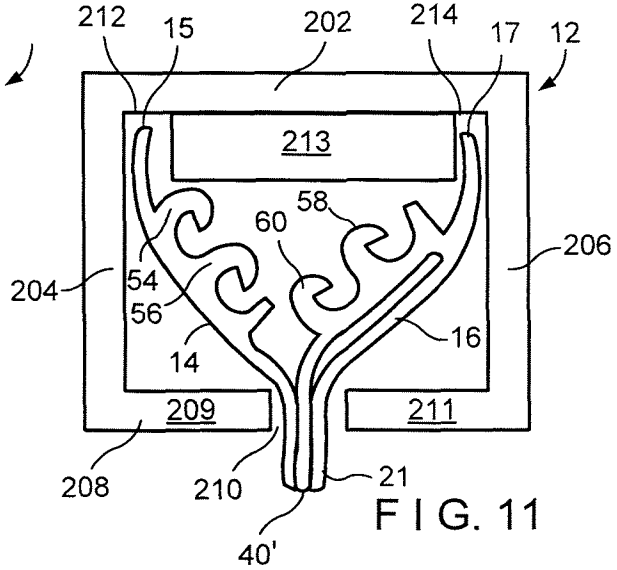
FIG. 11 is a cross-sectional view of a fourth embodiment of the zipper within a slider.

FIGS. 6B and 11 illustrate a similar embodiment as illustrated in FIGS. 5 and 6, except that lower inner flange 40' is added to the inner interlocking element of second zipper profile 16. This lower inner flange 40' is intended provide the same effect as first and second inwardly extended thickened protrusions 64, 66 of FIGS. 6A and 10 when captured between the inwardly facing slider retaining ribs 209, 211. This lower inner flange 40' could also be sealed to the first lower flange 19 by a seal, but only for the length of the slider 12 when the slider is at the closing end of the zipper 12. A variation of this alternative would be to make this lower inner flange 40' somewhat longer, provide it with a peel seal, and peel seal it to the full length of flange 19. This would also provide a tamper-evident zipper feature. When the zipper 10 is opened, the tamper-evident peel seal would be separated, but remain closed at the closing end for the length of the slider. A tack seal could be used as an alternative to the peel seal. Simultaneously with forming the peel seal or tack seal, the indicated area adjacent to the slider 12 could also be fully sealed.

Figure 13A:
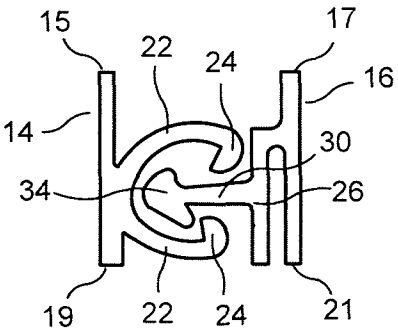
FIGS. 12, 13 and 13A are cross-sectional views of a further variation of the fifth embodiment, previously illustrated in FIG. 2.
Figure 12:
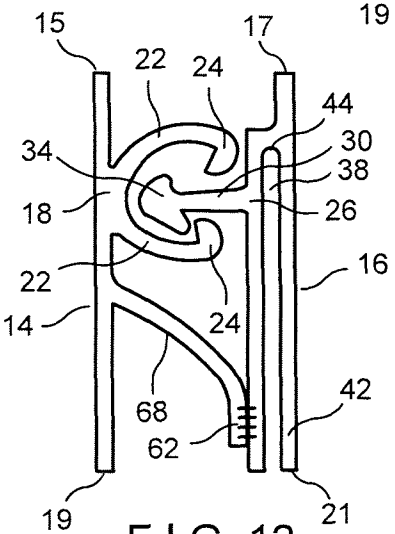

FIGS. 12 and 13A illustrate embodiments with a single-track zipper. FIG. 13A illustrates an embodiment wherein the lower flange length has been reduced requiring the zipper to be sealed to the film of a bag or package by its base rather than by its flange while FIG. 12 illustrates an embodiment wherein tamper-evident strip 68 extends from below female interlocking element 18 of first zipper profile 14 and is joined to second zipper profile 16 by a seal 62 which could be formed as a peel seal or a seal similar to the options described with respect to lower inner flange 40' of FIGS. 6B and 11.

Figure 13:
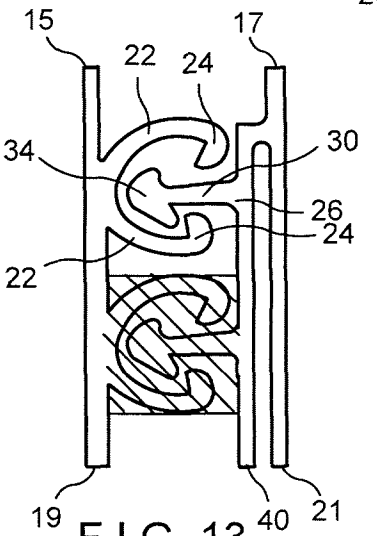

FIG. 13 illustrates an embodiment wherein double track zippers are employed, wherein the lower track formed by interlocking elements 20, 28 is sealed and the seal extends only the length of the slider 12 when the slider 12 is adjacent to the closing side seal 108.

Figure 14:
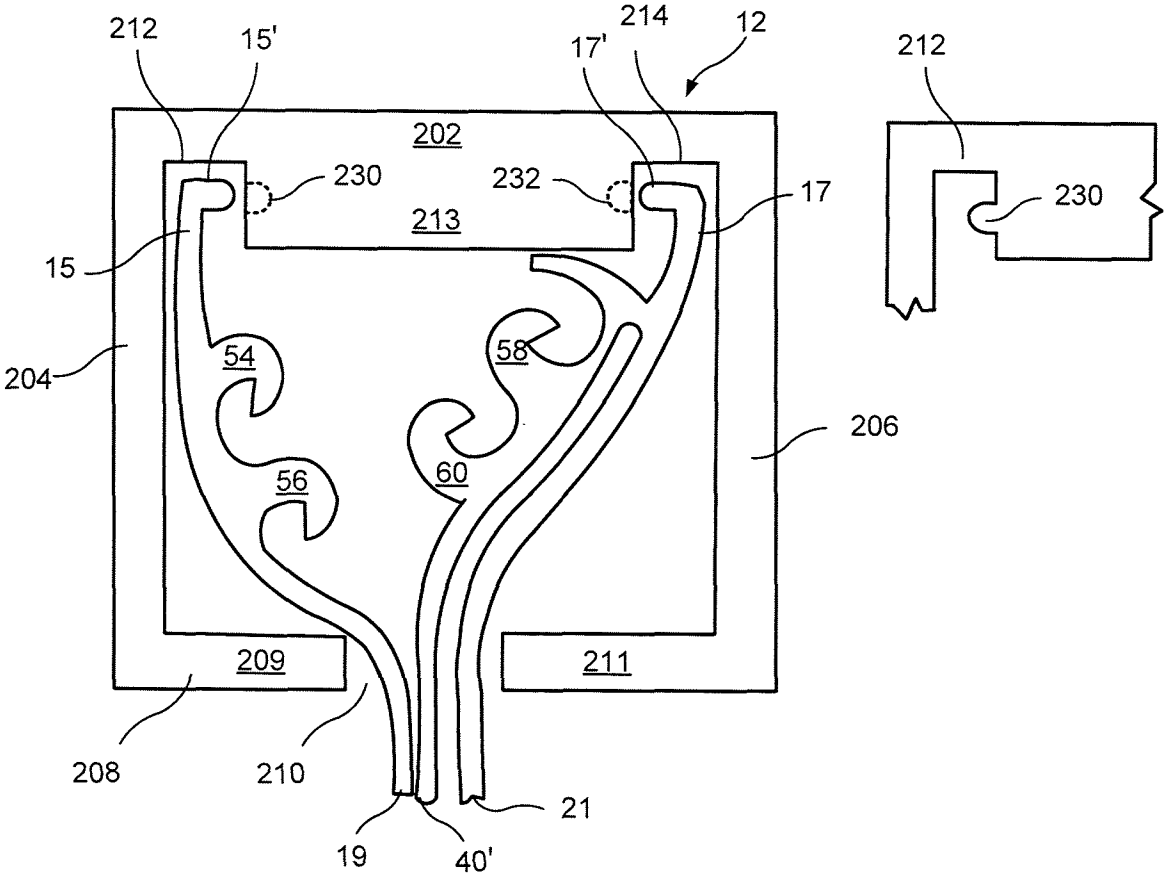
FIG. 14 is a cross-sectional view of a further variation of the fourth embodiment of the zipper within a slider of the present disclosure.

FIG. 14 illustrates an embodiment wherein upper flanges 15, 17 have protrusions 15', 17' or ribs with a cut-out sections and/or first and second channels 212, 214 forming slider wedge may include one or more dimples 230, 232, cavities, ribs or other undulations or irregularities for generating audible feedback, such as a clicking, as the slider 12 is moved.

Figure 15:
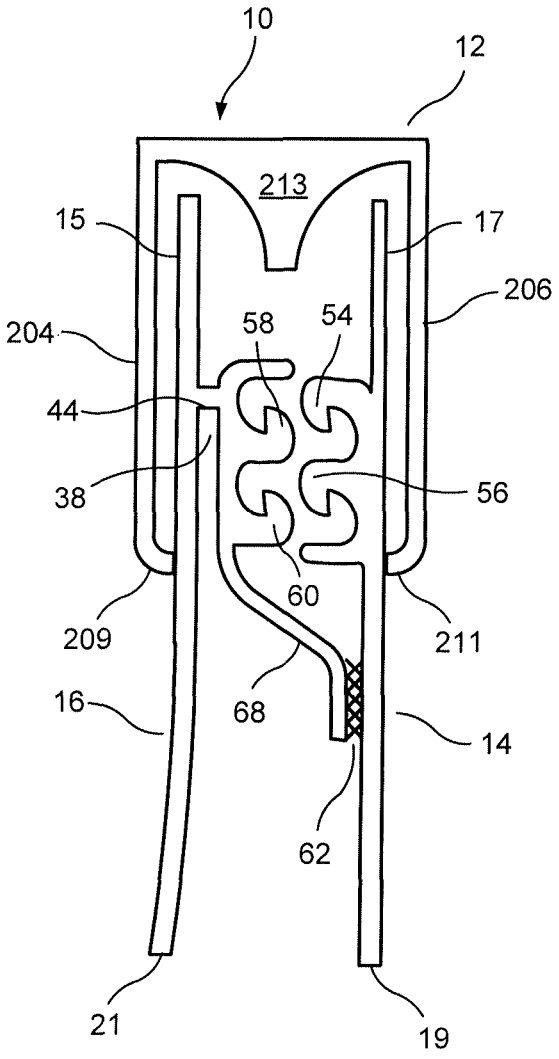
FIG. 15 is cross-sectional view of a further variation of the fourth embodiment of the zipper within a slider of the present disclosure.

FIG. 15 illustrates an embodiment of a zipper 10 similar to that of FIG. 5, but with a tamper evident strip 68 similar to that of FIG. 6B. In this embodiment, the hinge is incorporated in order to eliminate the need for a wishbone design in a larger high capacity bag. By adding the tamper evident strip 68 extending from the lower interlocking element of the second zipper profile 16 (which is hinged) and attached to first zipper profile 14 by peel seal 62, the total width of zipper 12 from the top of the profile to the bottom of the flange can be reduced. FIG. 15 further discloses an embodiment of the slider 12.

Typically, in the various disclosed embodiments, at the end side seals 106, 108 of the bag 10, the zipper flanges and interlocking elements, including any hinged portion, are fused together. Therefore, at a location directly adjacent to the end side seals 106, 108, the separating wedge 213 of the slider (at the opening end 12A of the slider) is not able to force the lower interlocking elements 20, 28 (see FIG. 2 or similar) apart. At the opposite or closing end 12B of the slider 12, the upper or first interlocking elements 18, 26 (see FIG. 2) and lower or second interlocking elements 20, 28 are held in an interlocked configuration by the slider 12. Between the two opposite ends of the slider 12 (where the interlocking elements are constrained and kept mated by either the closing end of the slider 12 or the end side seals 106, 108 of the bag 10), a portion of the upper or first interlocking elements 18, 26 will be forced open by the separating wedge 213 of the slider, but the lower or second male interlocking element 28 of the second zipper profile 16 (which, in FIG. 2, includes a hinge) will be maintained in engagement with the lower or second interlocking element 20 of the first zipper profile 14, thereby maintaining a leak-resistant seal. Alternately, when the lower interlocking elements are not maintained in engagement, other elements have to be provided in order to obtain a leak-resistant seal in the area of the disengaged lower interlocking elements.

When the slider 12 is moved away from the fully closed position illustrated in FIG. 1, there are no longer any constraints acting on the zipper 10 between the opening end 12A of the slider 12 and adjacent the opening end side seal 106, thereby allowing both the first and second male elements 26, 28 to be forced apart from the first and second female elements 18, 20 by the separating plough 219 and the separating wedge 213 of FIG. 7 at the opening end 12A of the slider 12.

Therefore, when the slider 12 is moved in the opening direction, the first and second upper flanges 15, 17 are forced apart by wedge-diverging channels 212, 214 of slider 12, thereby fully separating both sets of interlocking elements except for the length of the slider 12 when the slider 12 is adjacent or in contact with the opening end zipper or zipper bag end seal 106. Therefore, when the interlocking elements are separated, it is clearly visible to the consumer that the zipper 12 is open. When the slider 12 is moved in the closing direction, the slider closing end 12B fully interlocks both sets of interlocking elements except for the length of the slider 12 wherein the slider 12 is adjacent or in contact with the zipper or zipper bag closing end seal (proximate to closing side seal 108).

Within the slider 12, when the slider 12 is adjacent or in contact with the zipper or zipper bag end seal 106 or 108, the folded lower flange is pressed inwardly by the inward facing slider retaining ribs 209, 211 which maintains the lower interlocking elements 20, 28 interlocked, while the wedge 213, acting on the upper flanges 15, 17, maintains the upper interlocking elements 18, 26 in a separated configuration.

Accordingly, when the slider 12 is adjacent or in contact with the zipper bag end seal (proximate to side seal 106 or 108), a barrier is formed within the slider 12 between the inside and outside of the zipper bag 100 to which the zipper 10 has been attached, whose boundaries are the lower interlocked interlocking elements (L), and both of the interlocked interlocking elements at the slider closing end 12B (also marked as M) as shown in FIG. 1.

The dimensions of the width of the wedge 213 should be carefully considered. The width of the wedge 213 typically has to be wide enough within the confines of the slider 12 to fully separate the upper interlocking elements 18, 26 but in conjunction with the lower folded flange, maintain the lower interlocking elements 20, 28 interlocked (see FIG. 6). Similarly, the width of the wedge 213, if too narrow, will not separate the upper interlocking elements 18, 26. Typically, to achieve the above results, the width of wedge (G in FIG. 7) should be within the range of 2½ to 3½ times the size of the interlocked elements when interlocked, as measured from one outside surface to another outside surface (J in FIG. 8).

The opening end 12A of the slider 12 typically forms a rectangular shape between the upper surfaces of the inwardly facing slider retaining ribs 209, 211, the lower surface of wedge 213, and the inside of the side walls 204, 206, wherein the width of the opening end 12A of the slider 12 between the inside of the slider 12 sides is greater than the height of the opening end between the lower surface of wedge 213 and the upper surface of the inwardly facing slider retaining ribs 209, 211, which is generally inverse to much of the prior art. Furthermore, both sections of the upper interlocking elements 18, 26 come into contact with the lower surface of the wedge 213.

When loading or inserting the slider 12 onto the zipper 10, it is typically necessary to first separate the first and second upper flanges 15, 17 to allow the slider wedge 213 to be inserted between them. This requires a small separating plough 219 below the wedge 213 as shown in FIG. 7. This plough 219 is positioned above the interlocking elements. This plough 219 is structured to prevent the upper flanges 15, 17 from interfering with the insertion of the slider 12 onto the zipper 10.

It is envisioned that the thickness of the upper wall or bridge 202 above the upper zipper flanges (K in FIG. 7) should typically be between 0.40 and 0.55 inches. Above 0.55 inches, the slider 12 may become too stiff to be inserted on the zipper 10 (that is, above 0.55 inches, there is not enough flexibility for the slider sides 204, 206 to separate) and below 0.40 inches, the slider sides 204, 206 typically will not return to their original position and, rather, will remain apart and the slider 12 will not remain on the zipper 10.

As previously indicated, other alternative leak-resistant barrier combinations can be provided by other illustrated embodiments, wherein both sets of interlocking elements are separated within the slider. For example, in FIG. 9, the seal 62 is provided between the first and second lower flanges 19, 21 closely below the interlocking elements, wherein the seal 62 extends only the length of the slider 12, in a position where the slider 12 is in contact with the closing end side seal 108. Similarly, as shown in FIGS. 6A and 10, the first and second inwardly extended thickened protrusions 64, 66 in the area of the inwardly facing slider retaining ribs 209, 211 provide the leak-resistance. Similarly, as shown in FIGS. 6B and 11, the lower inner flange 40' provides the same function as the inwardly thickened protrusions 64, 66 of FIGS. 6A and 10. This lower inner flange 40' could be sealed to the first lower flange 19 thereby providing leak-resistance, but only for the length of the slider 12 when the slider is at the closing end of the zipper. As stated previously, a variation of this alternative would be to make the lower inner flange 40' somewhat longer, provide it with a peel seal, and seal it to the full length of the zipper 10. This would also provide a tamper-evident zipper feature. When the zipper 10 is opened, the tamper-evident peel seal would be separated, but remain closed at the closing end for the length of the slider. A tack seal could be used as an alternative to the peel seal. Simultaneously with forming the peel seal or tack seal, the area adjacent to the slider 12 could also be fully sealed. Such a tack seal or peel seal configuration would further allow the implementation of the single track configuration of FIG. 12. Similarly, as previously described and as shown in FIG. 13, by sealing the lower track formed by interlocking elements 20, 28 along only the length of the slider 12 when the slider 12 is adjacent to the closing side seal 108, the required leak resistance would be provided while allowing for the separation of the remainder of the double track zipper within the slider 12.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A zipper bag with a zipper opened and closed by a slider, including:

front and rear walls, joined together at a first side, a second side and a bottom, thereby forming a mouth;

the mouth being reclosable by a zipper, the zipper including:

a first profile with a first upper interlocking element, a first lower interlocking element, a first upper flange, and a first lower flange;

a second profile with a second upper interlocking element, a second lower interlocking element, a second upper flange and a second lower flange, wherein the second lower flange originates at an upper portion of the second upper interlocking element and is folded back on itself, extending along an exterior of the second upper interlocking element;

the first profile and the second profile being joined together at an opening end seal and a closing end seal;

the first and second upper flanges being continuous between the opening end seal and the closing end seal;

a slider having an opening end and a closing end, a first side and a second side, a bottom including inwardly facing ribs to maintain the slider on the first and second zipper profiles, and a top having a wedge positioned to engage the first and second upper flanges;

wherein when the slider is moved in a direction to open the zipper, the wedge forces apart the first and second upper flanges, thereby fully separating the first upper interlocking element from the second upper interlocking element and separating the first lower interlocking element from the second lower interlocking element up to a length of the slider when the slider is adjacent to the opening end seal, and when the slider is moved in a direction to close the zipper, the slider presses the first upper interlocking element to the second upper interlocking element and the first lower interlocking element to the second lower interlocking element along a full length of the zipper up to a length of the slider, when the slider is adjacent to the closing end seal; and wherein when the slider is adjacent the closing end seal, the first and second upper interlocking elements are separated from each other and the first and second lower interlocking elements are separated from each other, the first and second lower flanges are permanently sealed together below the first and second lower interlocking elements adjacent to the slider retaining ribs by a seal extending only a length of the slider from the closing end seal and not extending beyond the inwardly facing ribs.

2. The zipper bag of claim 1 wherein the first and second upper flanges are free of gaps and cut-outs.

* * * * *